US006965317B2

(12) United States Patent
Fujimoto

(10) Patent No.: US 6,965,317 B2
(45) Date of Patent: Nov. 15, 2005

(54) POSITIONAL INFORMATION MANAGEMENT SYSTEM

(75) Inventor: Jun Fujimoto, Tokyo (JP)

(73) Assignee: Aruze Corp., Tokyo (JP)

( * ) Notice: Subject to any disclaimer, the term of this patent is extended or adjusted under 35 U.S.C. 154(b) by 8 days.

(21) Appl. No.: 10/735,821

(22) Filed: Dec. 16, 2003

(65) Prior Publication Data

US 2004/0140906 A1 Jul. 22, 2004

(30) Foreign Application Priority Data

Dec. 16, 2002 (JP) ..... P2002-364346

(51) Int. Cl.[7] ..... G08B 23/00

(52) U.S. Cl. ..... 340/573.1; 340/825.36; 340/825.49

(58) Field of Search ..... 340/573.1, 825.36, 340/825.49, 539.11, 539.13, 539.14

(56) References Cited

U.S. PATENT DOCUMENTS

| | | | | |
|---|---|---|---|---|
| 5,455,851 | A | * 10/1995 | Chaco et al. | 379/38 |
| 6,154,139 | A | * 11/2000 | Heller | 340/573.4 |
| 6,225,906 | B1 | * 5/2001 | Shore | 340/573.4 |
| 6,396,413 | B2 | * 5/2002 | Hines et al. | 340/825.49 |
| 6,531,963 | B1 | 3/2003 | Nyfelt | |
| 6,825,763 | B2 | * 11/2004 | Ulrich et al. | 340/539.1 |
| 2002/0041234 | A1 | 4/2002 | Kuzma et al. | |
| 2002/0183979 | A1 | 12/2002 | Wildman | |

FOREIGN PATENT DOCUMENTS

| | | |
|---|---|---|
| JP | 2000-357272 | 12/2000 |
| JP | 2001-229350 | 8/2001 |
| JP | 2002-123619 | 4/2002 |
| JP | 2002-140631 | 5/2002 |
| JP | 2003-47775 | 2/2003 |
| JP | 2003-47779 | 2/2003 |
| JP | 2003-53041 | 2/2003 |
| JP | 2003-53042 | 2/2003 |
| JP | 2003-144760 | 5/2003 |
| JP | 2003-150838 | 5/2003 |
| JP | 2003-150852 | 5/2003 |
| JP | 2003-305271 | 10/2003 |

OTHER PUBLICATIONS

Brian W. Martin, "Watchlt, A Fully Supervised Identification, Location and Tracking System", Security Technology, 1995, Proceedings, Institute of Electrical and Electronics Engineers 29$^{th}$ Annual 1995 International Carnahan Conference on Sanderstead, UK Oct. 18–20, 1995, New York, NY, USA, IEEE, US, Oct. 18, 1995, pp. 306–310, XP010196430.

* cited by examiner

*Primary Examiner*—Toan N. Pham
(74) *Attorney, Agent, or Firm*—Leydig, Voit & Mayer, Ltd.

(57) ABSTRACT

A positional information management system according to the present invention comprises: a card carried by a user in a hotel and having a tag IC for storing a tag ID; a plurality of detectors each having a detector ID and being installed in the hotel, for detecting the tag ID via transmittance from the tag IC, the tag ID and the detector ID being transmitted; recording device for recording a pair of the tag ID and the detector ID, and a time at which the detector has detected; and positional information management device including the recording device, for managing positional information of the user, base on the pair and the time. Positional information of the users in the hotel or in the various hotel facilities can be obtained by the present invention.

13 Claims, 17 Drawing Sheets

*Fig.6*

POSITIONAL INFORMATION (DATA COLLECTION)

| DATE | TIME | TAG ID | LOCATION |
|---|---|---|---|
| | : | : | : |
| | 10:00 | C-9012 | P-1002 |
| | 10:00 | C-9023 | P-1003 |
| | 10:00 | C-1001 | P-2002 |
| | 10:00 | C-1002 | P-2002 |
| | 10:00 | C-3214 | P-3098 |
| | 10:01 | C-2003 | P-1002 |
| | 10:01 | C-2221 | P-1002 |
| | 10:01 | C-5236 | P-1002 |
| * * MONTH /* * DAY | 10:01 | C-9012 | P-1002 |
| | 10:01 | C-9041 | P-4023 |
| | : | : | : |
| | 19:35 | C-9036 | P-1002 |
| | 19:35 | C-9044 | P-1002 |
| | 19:35 | C-1001 | P-3012 |
| | 19:35 | C-1002 | P-3012 |
| | 19:35 | C-6523 | P-1003 |
| | 19:36 | C-2003 | P-5012 |
| | 19:36 | C-6002 | P-1002 |
| | 19:36 | C-7003 | P-1002 |
| | : | : | : |

Fig.7A

CORRESPONDENCE RELATIONSHIP OF:
TAG ID-GUEST ROOM NO.-NAME

| GUEST ROOM NO. | TAG ID | NAME OF USER |
|---|---|---|
| R－101 | C－1001<br>C－1002<br>C－1003 | ○○ ＊＊<br>○○ ＊△<br>○○ □△ |
| R－102 | － | － |
| R－103 | C－1234 | ＊＊ ○ |
| R－104 | C－2003<br>C－3571 | △ ＊＊<br>○× △△ |
| R－105 | C－7777 | ○○ ○○ |
| ： | ： | ： |

Fig.7B

CORRESPONDENCE RELATIONSHIP OF:
TAG ID-STAFF

| STAFF NO. | TAG ID |
|---|---|
| S－1001 | C－9001 |
| S－1002 | C－9002 |
| S－1003 | C－9003 |
| ： | ： |

*Fig.8*

POSITIONAL (MOVEMENT) INFORMATION (CUSTOMERS:BASED ON TAG ID)

| TAG ID | DATE | TIME | LOCATION |
|---|---|---|---|
| C-1001 | * * MONTH /* * DAY | 10:00 | P-2002 |
| | | : | : |
| | | 19:35 | P-3012 |
| | | : | : |
| C-1002 | * * MONTH /* * DAY | 10:00 | P-2002 |
| | | : | : |
| | | 19:35 | P-3012 |
| | | : | : |
| | | : | : |
| C-2003 | * * MONTH /* * DAY | 10:01 | P-1002 |
| | | : | : |
| | | 19:36 | P-5012 |
| | | : | : |

*Fig.9*

POSITIONAL (MOVEMENT) INFORMATION (STAFF:BASED ON TAG ID)

| TAG ID | DATE | TIME | LOCATION | PERMISSION |
|---|---|---|---|---|
| C-9001 | * * MONTH /* * DAY | : | : | O |
| | | 10:00 | P-2022 | O |
| | | 10:01 | P-2022 | O |
| | | 10:02 | P-2023 | O |
| | | : | : | O |
| | | 19:35 | P-2056 | O |
| | | 19:36 | P-2022 | O |
| | | 19:37 | P-2022 | O |
| | | : | : | : |
| C-9002 | * * MONTH /* * DAY | : | : | : |
| | | 10:00 | P-3002 | O |
| | | 10:01 | P-3003 | O |
| | | 10:02 | P-3005 | O |
| | | : | : | : |
| | | 19:35 | P-3002 | O |
| | | 19:36 | P-3002 | O |
| | | 19:37 | P-3002 | O |
| | | : | : | : |
| | | 20:33 | P-4001 | 1 |
| | | : | : | : |
| : | : | : | : | : |

*Fig.10*

POSITIONAL (MOVEMENT) INFORMATION (BASED ON LOCATION)

| LOCATION | DATE | TIME-POINT | TAG ID |
|---|---|---|---|
| P-1001 | * * MONTH /* * DAY | : | : |
| | | 10:00 | C-9003 |
| | | 10:00 | C-9014 |
| | | 10:00 | C-9005 |
| | | 10:01 | C-9003 |
| | | 10:01 | C-9005 |
| | | 10:02 | C-9003 |
| | | 10:02 | C-9005 |
| | | : | : |
| P-1002 | * * MONTH /* * DAY | : | : |
| | | 10:00 | C-9102 |
| | | 10:00 | C-9203 |
| | | 10:00 | C-9036 |
| | | 10:01 | C-9102 |
| | | 10:01 | C-9111 |
| | | 10:02 | C-9111 |
| | | 10:02 | C-9036 |
| | | : | : |

Fig.11

CARD USE HISTORY

| TAG ID | GUEST ROOM NO. | USE HISTORY |
|---|---|---|
| C−1001 | R−101 | **YEAR/**MONTH/**DAY/**HOUR:**MINUTE - **YEAR/**DAY/**HOUR:**MINUTE |
| | R−303 | **YEAR/**MONTH/**DAY/**HOUR:**MINUTE - **YEAR/**DAY/**HOUR:**MINUTE |
| | R−777 | **YEAR/**MONTH/**DAY/**HOUR:**MINUTE - **YEAR/**DAY/**HOUR:**MINUTE |
| | R−123 | **YEAR/**MONTH/**DAY/**HOUR:**MINUTE - **YEAR/**DAY/**HOUR:**MINUTE |
| | R−222 | **YEAR/**MONTH/**DAY/**HOUR:**MINUTE - **YEAR/**DAY/**HOUR:**MINUTE |
| | : | |
| C−1002 | R−888 | **YEAR/**MONTH/**DAY/**HOUR:**MINUTE - **YEAR/**DAY/**HOUR:**MINUTE |
| | R−456 | **YEAR/**MONTH/**DAY/**HOUR:**MINUTE - **YEAR/**DAY/**HOUR:**MINUTE |
| | R−159 | **YEAR/**MONTH/**DAY/**HOUR:**MINUTE - **YEAR/**DAY/**HOUR:**MINUTE |
| | R−258 | **YEAR/**MONTH/**DAY/**HOUR:**MINUTE - **YEAR/**DAY/**HOUR:**MINUTE |
| | R−369 | **YEAR/**MONTH/**DAY/**HOUR:**MINUTE - **YEAR/**DAY/**HOUR:**MINUTE |
| | : | : |
| : | : | : |

Fig.12

CORRESPONDENCE DATA OF: TAG ID-AREA

| TAG ID | AREA OF NORMAL EMPLOYMENT | RESTRICTED AREA |
|---|---|---|
| C-9001 | P2001 ~ P2999 | P4001 ~ P4010 |
| C-9002 | P3001 ~ P3999 | P4011 ~ P4020 |
| C-9003 | P2001 ~ P3999 | — |
| : | : | : |

*Fig. 14*

HOTEL SERVER

| | | | USER INFORMATION | | | | |
|---|---|---|---|---|---|---|---|
| DATE | GUEST ROOM NO. | TAG ID | NAME | RESIDENCE | TELEPHONE NUMBER | ... | INFORMATION PROVIDER AUTHENTICATED |
| ** MONTH /** DAY | R-101 | C-1001 | *** | **-**** | **-*** | ... | ○ |
| | | C-1002 | *** | **-**** | **-*** | ... | × |
| | R-102 | – | – | – | – | – | – |
| | R-103 | C-3256 | *** | **-**** | **-*** | ... | – |
| | R-104 | C-3141 | *** | **-**** | **-*** | ... | ○ |
| | | C-2147 | *** | **-**** | **-*** | ... | ○ |
| | R-105 | – | – | – | – | – | – |
| | : | : | : | : | : | : | : |

PROVISION OF SERVICES IN ACCORDANCE WITH POSITIONAL INFORMATION

POSITIONAL INFORMATION MANAGEMENT SYSTEM

CROSS REFERENCE TO RELATED APPLICATIONS

This application is based upon and claims the benefit of priority from the prior Japanese Patent Application No. 2002-364346, filed in Japan on Dec. 16, 2002; the entire contents of which are incorporated herein by reference.

This application is related to co-pending U.S. patent application entitled "POSITIONAL INFORMATION MANAGIMENT SYSYTEM" referred to as the prior Japanese Patent Application No. 2002-364347, filed in Japan on Dec. 16, 2002. The co-pending application including specification, drawing and claims are expressly incorporated herein by reference in its entirety.

BACKGROUND OF THE INVENTION

1. Field of the Invention

The present invention relates to a positional information management system in a hotel, whereby, in hotels or various facilities that are provided in hotels, it is possible to ascertain and manage the location of a user.

2. Related Background Art

Technology involving the use of magnetic cards or IC cards in hotels and related facilities has previously been proposed. For example, a system has been proposed in which a card key is employed instead of a mechanical key as the key of a guest room and a system has been proposed in which settlement of charges for use is performed using a card. It has also been proposed to simplify management of customers, guest rooms, facilities or office work by giving a non-contact IC card a booking function for facilities of various types and/or a function of service point management. Such management of hotel business or related facilities is proposed in for example Laid-open Japanese Patent Application No. 2000-357272.

In the conventional system, individual processes such as for example opening/closing of locks, settlement of charges for use, booking, or service point management are managed in management of for example customers, guest rooms, facilities or offices. In the conventional system, information regarding the movement of users within hotels and the various facilities is not acquired. In the conventional system, information regarding the user's utilization of the various facilities provided by hotels is not acquired.

In order to increase the efficiency of utilization of hotels and the various facilities thereof, to increase customers' convenience, and to improve security of hotels and the various facilities thereof, it is necessary to know how users are moving within the hotel and the facilities.

In conventional systems, since management is merely performed treating each process as a unit, there is the problem that even if improvement in efficiency of the individual processes is sought, it is not possible to perform integrated management including for example the history of movement of users in the hotel or related facilities as a whole.

Accordingly, an object of the present invention is to solve the problems described above and to ascertain positional information of users in a hotel or the various facilities provided by a hotel.

SUMMARY OF THE INVENTION

According to the present invention, users carry a card having a tag ID and detectors that detect this tag ID are installed at various locations in the hotel or facility. The location of the user is detected and recorded by detecting the tag ID by means of these detectors. The positional information of the user in the hotel or the various facilities provided by the hotel can thereby be ascertained.

The user includes not only customers but also employees of the hotel or facility. By knowing customer movement history regarding when the customers use hotel facilities and what kind of hotel facilities they use, it is possible to adaptively manage hotel work taking into account customer trends and intentions. Also, by knowing the movement history of staff members, it is possible to adaptively manage the disposition of the staff members and/or the staff members themselves. In addition, the security of the hotel or facility can be improved by utilizing movement history regarding customers and staff members. Herein below, when "within the hotel" is referred to, it is intended to include "within the facilities provided by the hotel".

The positional information management system according to the present invention can be applied for example in regard to movement history as to how a specific user is moving, in regard to movement history as to how users are moving in a specific location, in regard to searching to ascertain where a specified user is in the hotel or facility, in regard to the provision of services in respect of customers within the hotel or facility, or in regard to ascertaining whether a user is in a specified area within the hotel or facility.

A positional information management system according to the present invention consists in a system for managing positional information of users in a hotel, comprising a card carried by a user in a hotel and having a tag IC for storing a tag ID; a plurality of detectors each having a detector ID and being installed in the hotel, for detecting the tag ID via transmittance from the tag IC, the tag ID and the detector ID being transmitted; recording means for recording a pair of the tag ID and the detector ID, and a time at which the detector has detected; and positional information management means including the recording means, for managing positional information of the user, base on the pair and the time.

The each card has a tag IC in which a tag ID is recorded. By establishing a one-to-one correspondence of this tag ID and the card, the card itself can be identified by means of the tag ID and, furthermore, the user carrying this card can be identified.

The detector constitutes detection means that detects the tag ID recorded on the tag IC via transmittance from the tag IC. The detectors are provided with a detector ID that is individually allocated and are installed at various locations in the hotel or in the various facilities of the hotel. The detectors send the detected tag ID together with its detector ID to positional information management means.

The recording means records the tag ID and the detector ID sent from the detectors as a pair, together with the detection time. The positional information management means is provided with recording means as described above and manages the positional information of users in accordance with the tag ID, the detector ID and the detection time.

In a first mode of use of the present invention, the movement history of users is managed. In this mode, the positional information management means detects the movement history of a user carrying a card within the hotel by identifying the user from the tag ID of the card recorded in the recording means, identifies the location of the user carrying the card from the location of the detector from the detector ID and identifies the time from the detection time.

The users include hotel customers and hotel staff members; the movement history of customers and the movement history of staff members are separately managed using the tag IDs.

In a second mode of use of the present invention, the movement history of users in a specific range is managed. In this mode, the positional information management means detects the movement history of users within the hotel from the specific range that has been set as the range of detection of each detector ID and the user identified by the tag ID detected in this specific range. In this mode, it is possible to ascertain the state of utilization of a specific range (facility or the like) in the hotel.

The users may be identified as hotel customers or hotel staff members and whether the users are customers or staff members can be distinguished from the tag ID, making it possible to manage the movement history of customers and the movement history of staff members separately.

In a third mode of use of the present invention, searching for users is managed. In this mode, the positional information management means detects the detector ID which constitutes a pair with the tag ID corresponding to the user that is being searched for based on pairs of the tag IDs and the detector IDs recorded by the recording means, and is thereby able to find the location of the user in the hotel from the location of the detector having the detector ID that has thus been detected.

The positional information management system further comprises a terminal that is connected with the positional information management means. As this terminal, a front desk terminal or a card terminal could be employed. A front desk terminal means a terminal that is provided at the front desk of the hotel and a card terminal means a terminal that is provided within the hotel or facilities thereof. These terminals detects the tag ID via transmittance from the tag IC of the card and requests the positional information management means to search for a user (a user himself or another user) based on the tag ID. The positional information management means searches for the locations of the user (the user himself or another user) within the hotel based on the tag ID that is input (read) at the terminal, and sends this positional information to the terminal.

The correspondence relationship between the name of the user and the tag ID of the card that is carried by the user is recorded in the recording means; the positional information management means can find the tag ID from the name of the user that is being searched for and a search can also be conducted at the terminal for the location of the user in the hotel based on the name of the user.

In a fourth mode of use of the present invention, services provided by the hotel are managed. In this mode, the positional information management system further comprises service management means for matching services provided to customers who are users.

The service management means sends the tag ID of the card carried by a customer to the positional information management means. The positional information management means detects the detector ID that constitutes a pair with the tag ID, and sends information as to the location of the detector corresponding to the detector ID to the service management means. It should be noted that, when information regarding the location of the detector that has the detector ID that forms a pair with the tag ID is sent to the service management means, this "information regarding the location" is termed "positional information". The service management means can thereby manage the services that are provided to the customers by using the positional information of customers.

Also, the service management means sends the tag ID of the card that is carried by a staff member who is a user to the positional information management means. The positional information management means then detects the detector ID that constitutes a pair with the tag ID and sends the location of the detector corresponding to the detector ID to the service management means. In this way, the service management means can manage the services that are provided to customers by using the positional information of staff members.

In a fifth mode of use of the present invention, the presence or absence of users in a specific region within the hotel is managed. In this mode, the positional information management means establishes an area defined by at least one detector ID. The positional information management means then detects the detector ID that constitutes a pair with the detected tag ID based on the pairs of tag IDs and detector IDs recorded by the recording means. In addition, the positional information management means determines whether or not the user who carries the detected tag ID is present in the area, by comparing the detected detector ID with the detector ID that defines the area.

Thus, by establishing the area as a restricted area, if it is determined that a user who is not approved is present in the restricted area, security management can be conducted by generating an alarm or by setting a flag in the recording means.

It should be noted that the present invention could be embodied in the form of a system, in the form of a program for implementing the system, or in the form of a recording medium on which this program is recorded.

It should be noted that the card to which the present invention is applied could also be utilized for example as a card of the type referred to as a house card. A house card comprises functions such as the function of a key for opening and closing the locks of guest rooms of the hotel or a function of performing settlement processing by recording the state of utilization of hotel facilities.

The present invention will be more fully understood from the detailed description given herein below and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

FIG. 6 is an example of data collected by a positional information management system according to the present invention;

FIG. 7A is an example of correspondence data showing the correspondence relationship of tag ID and guest room No. in a positional information management system according to the present invention;

FIG. 7B is an example of correspondence data showing the correspondence relationship of tag ID and staff No. in a positional information management system according to the present invention;

FIG. 8 is an example of positional information of a customer used in a positional information management system according to the present invention;

FIG. 9 is an example of positional information of a staff member used in a positional information management system according to the present invention;

FIG. 10 is an example of movement history of a user at a specified location used in a positional information management system according to the present invention;

FIG. 11 is an example of use history information of cards used in a positional information management system according to the present invention;

FIG. 12 is an example of restricted area data;

FIG. 14 is an example of data provided by a positional information management system hotel server according to the present invention;

DESCRIPTION OF THE PREFERRED EMBODIMENTS

Figure 1:
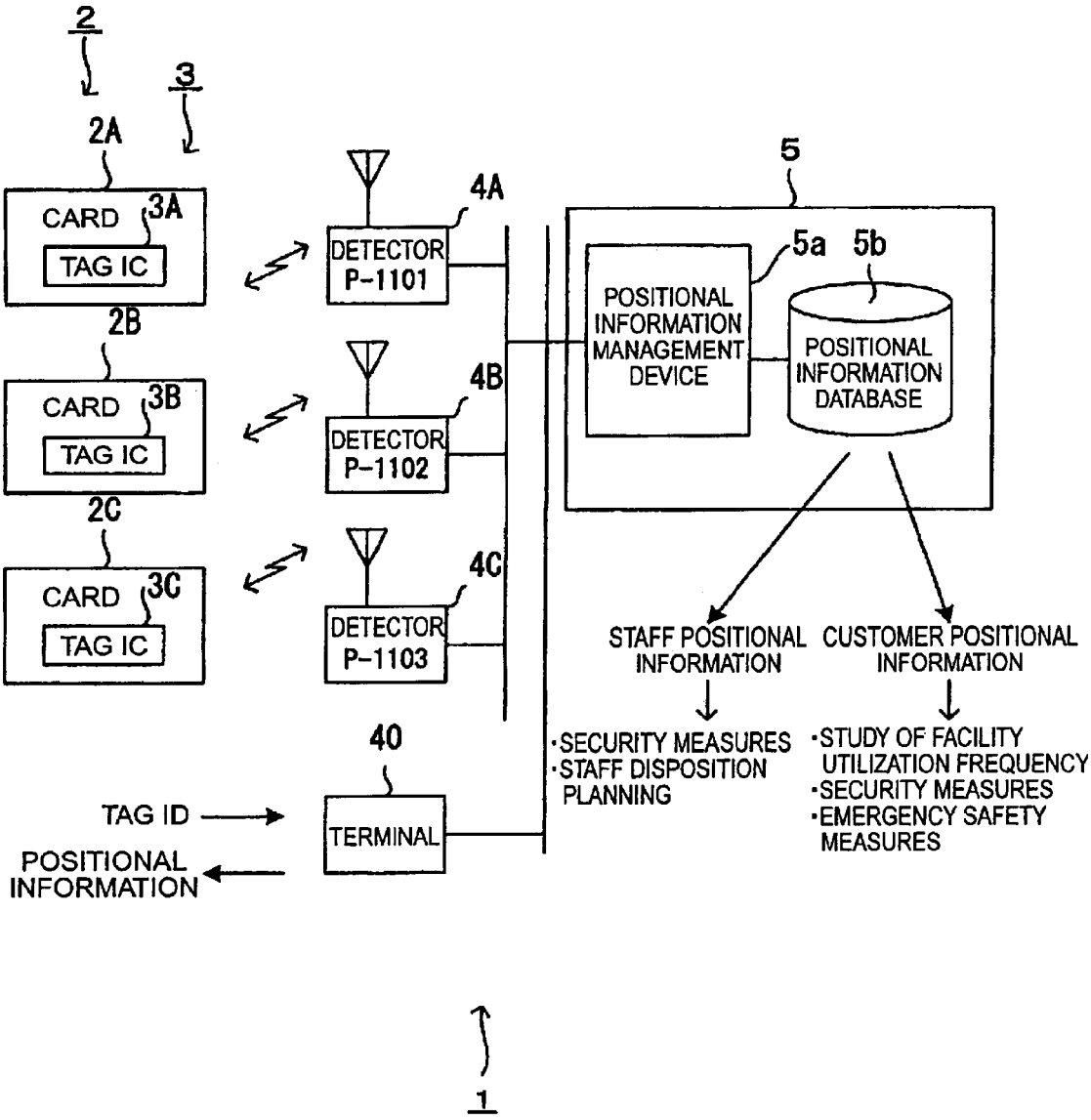
FIG. 1 is a block diagram given in explanation of a positional information management system according to the present invention.

Embodiments of the present invention are described in detail below with reference to the drawings. FIG. 1 is a diagram given in explanation of an outline of a positional information management system according to the present invention. In FIG. 1, a positional information management system 1 comprises cards 2 (2A to 2C), tag ICs 3 (3A to 3C), detectors 4 (4A to 4C) and a positional information management server 5.

Cards 2 (2A to 2C) respectively comprise tag ICs 3 (3A to 3C) in which is respectively set an individual tag ID and are carried by each user. Detectors 4 (4A to 4C) have respective individual detector IDs and exchange signals with the tag ICs 3 (3A to 3C) and can thereby read the tag ID that is set in a tag IC3 (3A to 3C). These detectors 4 (4A to 4C) are installed at various locations in the hotel or facility.

A tag ID as employed in the present invention performs exchange of signals with a tag IC by utilizing for example electromagnetic induction of a coil. A detector comprises a transmitter that transmits a carrier wave and a demodulator that demodulates the response signal (response wave) that is emitted from a tag IC in response to the transmitted carrier wave. The coil of a tag IC comprises a modulator that modulates with the tag ID the response wave induced by the carrier wave. The tag IC of a card returns to the detector a tag ID in response to the carrier wave of a read signal transmitted from the detector.

This tag IC may be formed in the shape of a sheet and may also be manufactured by a printing technique.

Detectors 4 (4A to 4C) are connected with the positional information management server 5 by for example an internal LAN and transmit the detected tag ID, together with the detector ID with which each detector 4 is provided, to the positional information management server (positional information management means) 5. A positional information management device 5*a* of the positional information management server 5 receives the tag ID and the detector ID transmitted from the detector 4 (4A to 4C) and defines this tag ID and the detector ID as a pair, which it then records in a positional information database (recording means) 5*b* together with the detection time. This tag ID can specify the user who is carrying the card 2, by specifying this tag ID. Also, by specifying the detector ID, the location where the detector 4 is installed in the hotel can be specified. Also, the time-point information can specify the time point at which the card 2 was present (or passed) the vicinity where the detector 4 is installed. Positional information of the user carrying the card can therefore be acquired by means of this tag ID, detector ID and time-point information.

The tag ID, detector ID and time-point information recorded in the positional information database 5*b* can be read by requesting positional information using for example the tag ID information, from a terminal 40 connected with the positional information management server 5.

Also, if the user is a customer, customer positional information can be acquired from the positional information recorded in the positional information database 5*b*. In addition, this customer positional information can be utilized for example to investigate the frequency of use of various facilities, in security measures and in safety measures for emergency situations. Also, if the user is a staff member of the hotel or facility, staff positional information can be acquired. In addition, these items of positional information can be utilized in for example security measures or staff disposition management.

It should be noted that although, for purposes of explanation, an example is illustrated in FIG. 1 in which there are three cards 2 and tag ICs 3, there could be any required plurality of these, in accordance with the number of users using the hotel or facility. Also, regarding the detectors 4, although, for purposes of explanation, an example in which there are three detectors is illustrated in FIG. 1, any desired plurality of detectors could be employed in accordance with the size of the hotel or facility or range or accuracy of the detectors.

Figure 2:
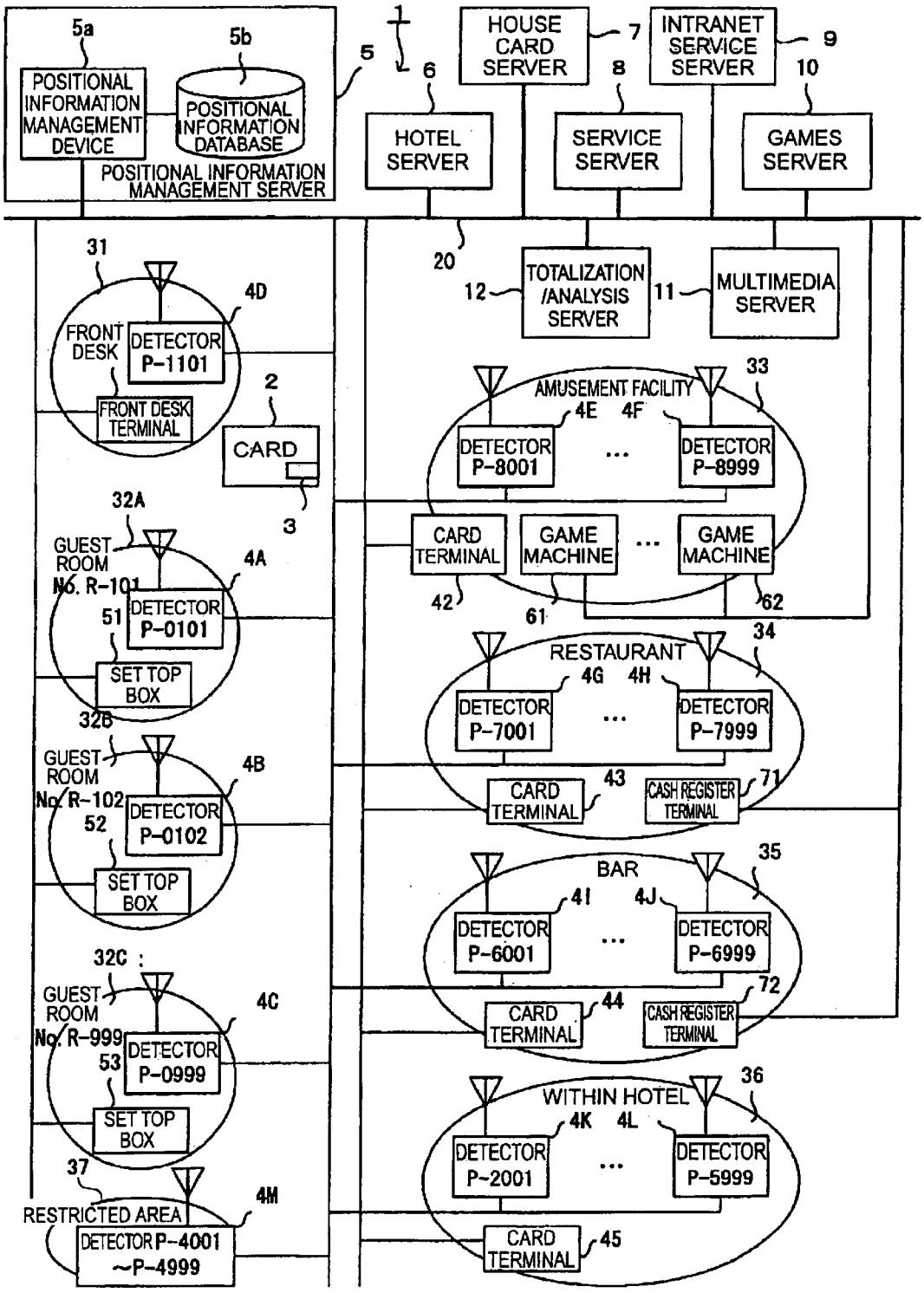
FIG. 2 is a diagram given in explanation of a more detailed example of the construction of a positional information management system according to the present invention.

FIG. 2 is a diagram given for purposes of explanation of an example of a more detailed layout of a positional information management system 1 according to the present invention.

In FIG. 2, just as in the case of the layout example of FIG. 1, the positional information management system 1 comprises cards 2, tag ICs 3, detectors 4 (4A to 4M) and a positional information management server 5. In addition, various servers such as a hotel server 6, house card server 7, service server (service management means) 8, intranet server 9, games server 10, multimedia server 11 or totalizing/analysis server 12 may be connected to the positional information management system 1 by means of a network such as an internal LAN.

The hotel server 6 is a server that performs overall management of hotel tasks typically performed by a hotel. The house card server 7 is a server that performs individual account management in the hotel when a customer employs a house card that performs payment processing by a deposit system to use the hotel or the various facilities (gaming facilities such as casinos or restaurants) with which the hotel is provided.

The service server 8 is a server that handles booking and issue of tickets for shows or events conducted in the hotel or facilities. The intranet server 9 is a server that manages a casino or games by means of an intranet within the hotel. The game server 10 is a server that performs management of deposits processed in gaming facilities. The multimedia server 11 is a server for on-demand use of video information in the guest rooms. Also, the totalizing/analysis server 12 is a server that performs flow management of the movement of customers, or staff members' disposition management, using positional information acquired by the positional information management server 5.

The cards 2 are provided with tag ICs 3 in which are respectively set individual tag IDs, so that a card 2 can be identified from this tag ID. In addition, a user can be identified from the correspondence relationship between cards 2 and users.

The detectors 4 are installed in various locations of the hotel and facilities. For example, detectors 4A to 4C are installed in guest rooms 32A to 32C, a detector 4D is installed at the front desk 31, detectors 4E to 4F are installed in an amusement facility 33, detectors 4G to 4H are installed in the restaurant 34, detectors 4I to 4J are installed at the bar 35, detectors 4K to 4L are installed at various other locations 36 within the hotel, and a detector 4M is installed in a restricted area 37 that is set up within the hotel.

Respective individual detector IDs are set for the detectors 4 and are managed together with the positional information as to where the detectors 4 are provided. A database whereby the detector IDs and the locations of installation of detectors 4 having these detector IDs are associated is stored in the positional information database 5*b* described above. It is thereby possible to ascertain location within the hotel or facility from the detector ID.

A detector 4D is provided at the front desk 31. The detector 4D is specified and its location is specified by means of the detector ID (for example, P-1101) that is set in the detector 4D. Also, in the front desk 31, there is installed a terminal 41 that performs the various front desk tasks, being connected with for example the hotel server 6, house card server 7, service server 8, and totalizing/analysis server 12. The front desk terminal 41 is connected with the positional information management server 5 and has the function of acquiring positional information.

Detectors 4A to 4C are provided in each guest room 32A to 32C; the detectors 4A to 4C are identified and their location can be specified by means of the detector ID that is set in each detector 4A to 4C (for example P-0101 to P-0999). Also, set-top boxes 51 to 53 may be provided for users of the casino or games by the intranet or multimedia services such as music or video may be used online in the guest rooms 32A to 32C.

Detectors 4E to 4F are installed in the amusement facility 33 and the detectors 4E to 4F are specified and their locations can be specified by means of the detector IDs (for example, P-8001 to P-8999) that are set in the detectors 4E to 4F. Also, the amusement installation 33 comprises various types of game machines 61 to 62 and a card terminal 42 whereby settlement of deposits is performed using the house card or like. Also, this card terminal 42 may be given a function of acquiring positional information by being connected with the positional information management server 5.

Detectors 4G to 4H are installed in the restaurant 34; the detectors 4G to 4H are identified and their location can be identified by means of the detector IDs (for example, P-7001 to P-7999) that are set in the detectors 4G to 4H. Also, a terminal 71 whereby settlement is performed and a card terminal 43 for performing settlement of deposits are installed in the restaurant 34. It should be noted that this card terminal 43 is also connected with the positional information management server 5 and is provided with a function of acquiring positional information.

Detectors 4I to 4J are installed at the bar 35; the detectors 4I to 4J can be specified and their location specified by means of the detector IDs (for example, P-6001 to P-6999) that are set in these detectors 4I to 4J. Also, at the bar 35, there are provided a cash register terminal 72 for performing settlement and a card terminal 44 for performing deposit settlement. It should be noted that this card terminal 44 is also connected with the positional information management server 5 and also has the function of acquiring positional information.

Detectors 4K to 4L are installed at various locations in the hotel 36; the detectors 4K to 4L can be specified and their location can be specified by means of the detector IDs (for example P-2001 to P-5999) that are set in these detectors 4K to 4L. Also, a card terminal 44 is installed in the hotel 36. This card terminal 44 is also connected with the positional information management server 5 and has the function of acquiring positional information.

In addition, a restricted area 37 to which only entry of predetermined specified persons is permitted, entry of other persons being restricted, is provided in the hotel. A plurality of detectors 4M are installed also in this restricted area 37; the detectors 4M are specified and their location is specified by means of the detector IDs (for example, P-4001 to P-4999) that are set in the detectors 4M.

Figure 3:
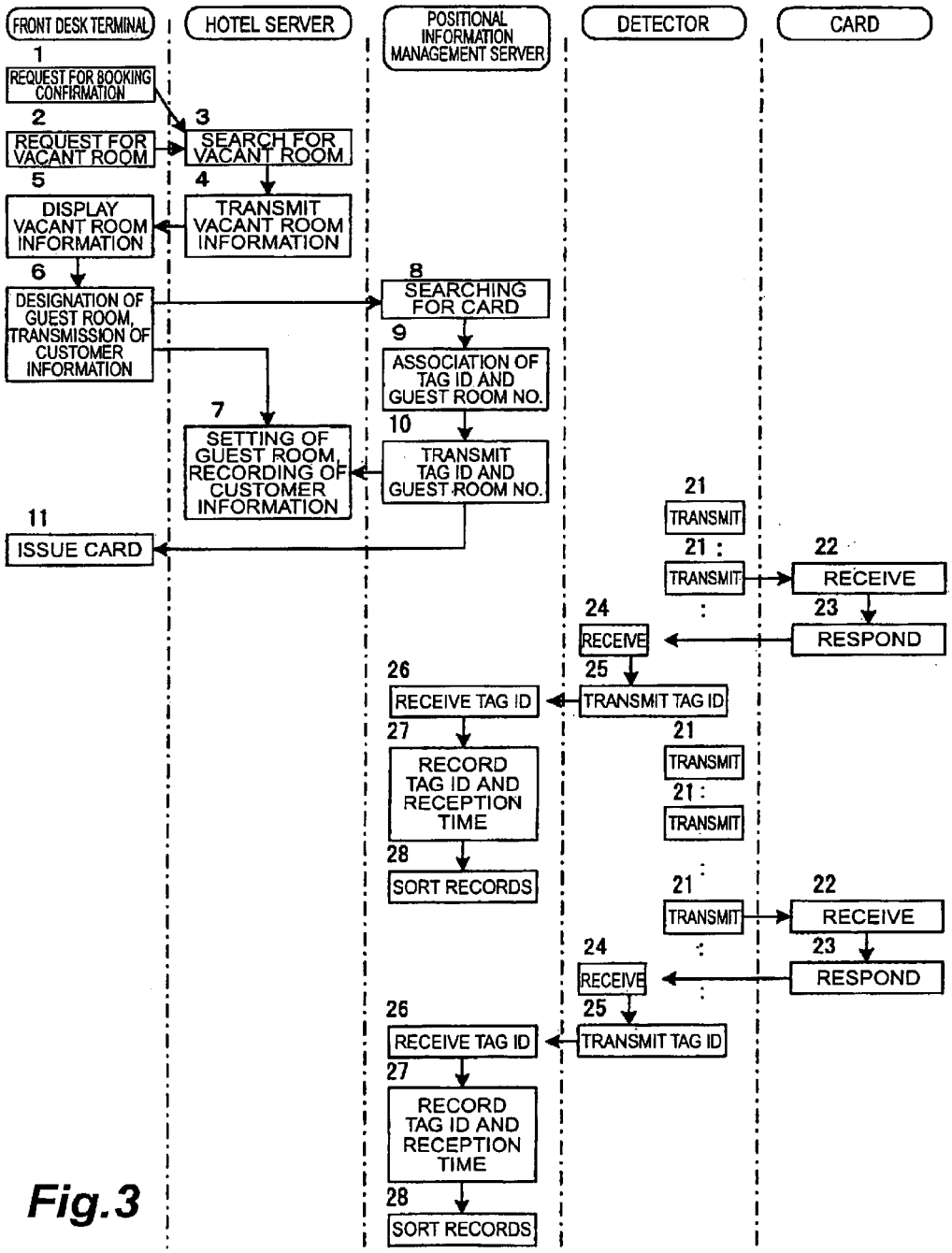
FIG. 3 is a diagram of operating condition given in explanation of the operation of a positional information management system according to the present invention.

Next, the operation of a positional information management system according to the present invention will be described with reference to FIG. 3. The numbers indicated herein below in brackets ( ) correspond to the numbers associated with the respective operations in FIG. 3.

The operations (1) to (11) herein below indicate a card issuing operation and the operations (21) to (28) indicate positional information acquisition operations.

First of all, issuing of a card will be described. When a booking confirmation request or a room request is issued (1, 2) to the hotel server from the front desk terminal on reception of the guest at the front desk, the hotel server searches for a vacant room (3) and transmits vacant room information to the front desk terminal (4). This vacant room information is displayed (5) at the front desk terminal. After the guest room to be used has been determined, the front desk terminal transmits the guest room No. and/or customer information to the hotel server and transmits (6) for example the guest room No. and/or customer's name and/or information as to the number of the credit card whereby payment on settlement will be performed to the positional information management server.

The hotel server performs setting of the guest room in accordance with the information that is transmitted thereto and records the customer information (7). The positional information management server, using the information that has been transmitted thereto, selects (8) a card that may be used from cards that are not being used, by referring to the correspondence relationship of guest room numbers and cards (or the tag IDs that are set on the cards), associates and records (9) the tag ID that is set in the selected card and the guest room No., and transmits (10) the information of this tag ID and the guest room No. to the hotel server and front desk terminal. Using the tag ID that has thus been received, the hotel server adds the tag ID to the aforesaid customer information and records (7) this tag ID and the guest room No. information. Also, the front desk terminal issues to the customer a card in which this tag ID that has thus been received is set (11).

Acquisition of positional information is conducted by exchange of signals between the detectors and the tag ICs of the cards. A call signal for performing exchange of signals with the tag ICs is transmitted (21) constantly or at prescribed time intervals from a plurality of detectors installed in the hotel and facilities.

When, as the user carrying a card 2 moves, the card approaches some detector 4, the tag IC 3 provided in the card 2 receives (22) a signal sent from the detector 4 and sends (23) a response signal including its tag ID. The detector 4 receives (24) this response signal. The detector 4 reads the tag ID from the response signal which it receives and transmits (25) this tag ID and its detector ID to the positional information management server 5.

The positional information management server 5 receives (26) the tag ID and the detector ID and records these (27) together with the time-point information at which they were received and sorts (28) the recordings. The aforesaid processes (21) to (28) are performed in respect of each detector that is installed in the hotel or facility.

FIG. 4 is a signal diagram given in explanation of the way in which signals are exchanged between a tag IC and detector. Exchange of signals between the tag IC and the detector may be performed at predetermined time intervals or may be performed constantly. That is, the carrier wave may be transmitted intermittently at prescribed intervals or may be continuously transmitted. FIGS. 4A to C and D show an example where transmission is performed at prescribed time intervals and FIGS. 4E, F and D show an example where transmission is performed constantly.

Figure 4A:
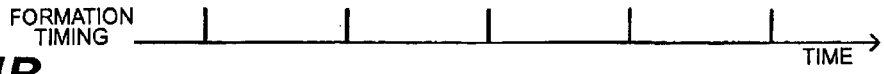
FIG. 4A is a signal diagram (formation timing signal) given in explanation of how signals are exchanged between a tag IC and a detector.
Figure 4B:
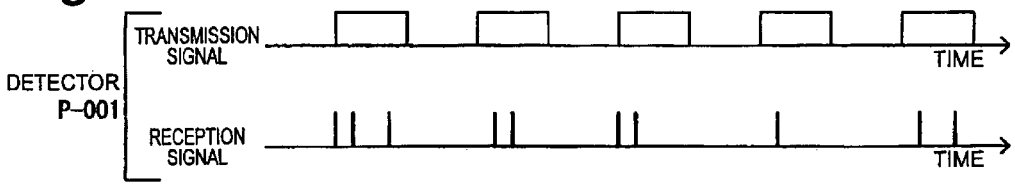
FIG. 4B is a signal diagram (signals exchanged by detector P-001: transmission signal disconnection) given in explanation of how signals are exchanged between a tag IC and a detector.
Figure 4C:
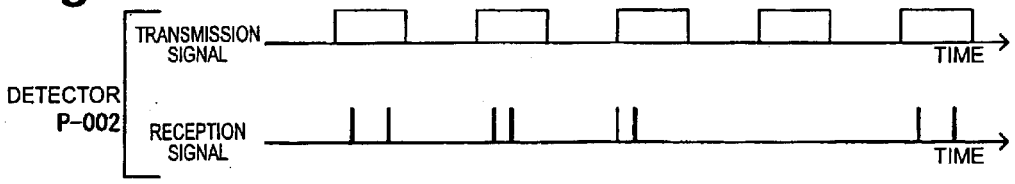
FIG. 4C is a signal diagram (signals exchanged by detector P-002: transmission signal disconnection) given in explanation of how signals are exchanged between a tag IC and a detector.
Figure 4D:
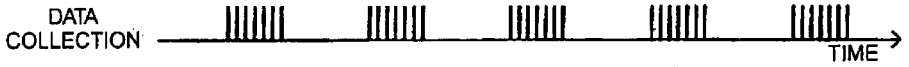
FIG. 4D is a signal diagram (data collection signal) given in explanation of how signals are exchanged between a tag IC and a detector.

In the case where transmission is performed at prescribed time intervals, the prescribed time interval at which signal exchange is conducted may be set by means of a formation timing signal as shown in FIG. 4A. The detector 4 generates a transmission signal (transmission signal in FIGS. 4B and C) in response to this formation timing signal of FIG. 4A. The detector 4 receives (received signals in FIGS. 4B and C) the response signal transmitted from the tag IC 3 in response to this transmitted signal. The reception signals detected by the detectors 4 are collected by the positional information management server (FIG. 4D).

Figure 4E:
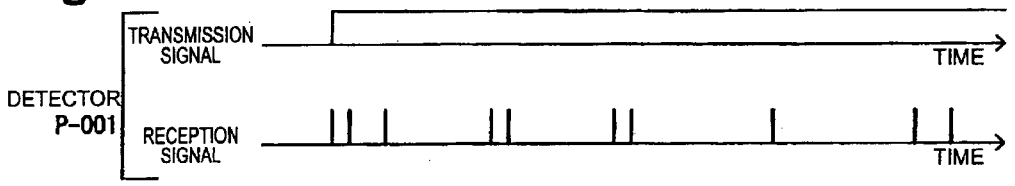
FIG. 4E is a signal diagram (signals exchanged by detector P-001: transmission signal continuation) given in explanation of how signals are exchanged between a tag IC and a detector.
Figure 4F:
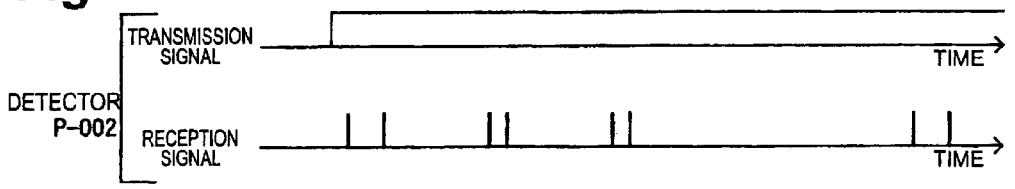
FIG. 4F is a signal diagram (signals exchanged by detector P-002: transmission signal continuation) given in explanation of how signals are exchanged between a tag IC and a detector.

Also, in the case where signal exchange is conducted constantly, the detector 4 generates a transmission signal (transmission signals in FIGS. 4E and F). The detector 4 receives (received signal in FIGS. 4E and F) a response signal transmitted from the tag IC 3 in response to this transmission signal. The Figure shows the detection of a single peak in the received signal. The received signals detected by the detectors 4 are collected by the positional information management server (FIG. 4D).

Figure 5:
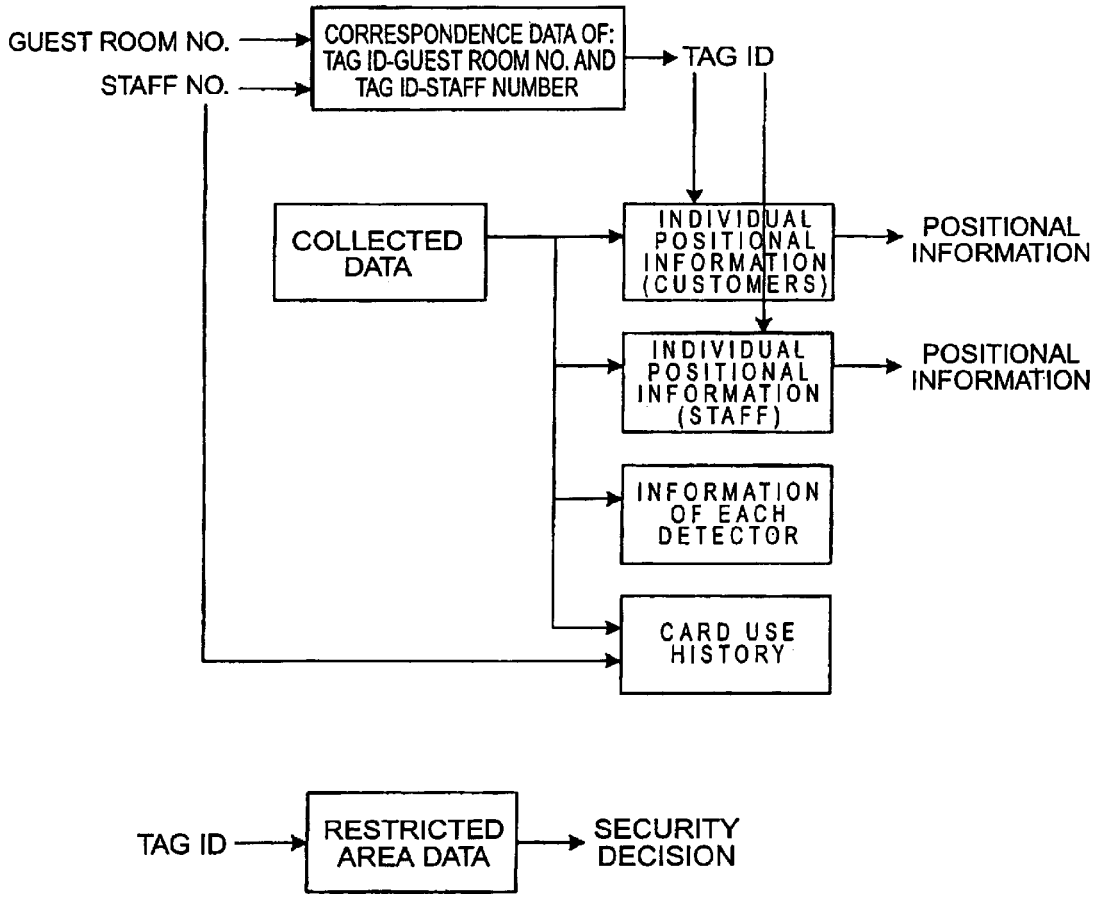
FIG. 5 is a view showing in tabular form an example of an information mode using a positional information management system according to the present invention.

Next, an example of utilization of the information obtained by the positional information management system according to the present invention will be described with reference to FIG. 5 or to FIG. 12. FIG. 5 shows an example of utilization of information obtained by a positional information management system according to the present invention. The collected data collected from the detectors includes tag IDs, detector IDs and time-point information.

FIG. 6 shows an example of the collected data. As the collected data, the detected tag ID and detector ID (or detector location) are recorded in the order of detection time. Since the detector IDs and detector locations are in one-to-one correspondence, both the detector ID and detector location can be recorded. If the detector ID of the detector is recorded, it is possible to ascertain the location of installation thereof by referring to the correspondence relationship of the detector IDs and installation locations.

By sorting this collected data using the tag ID, it is possible to acquire the positional information of each user. Users can also be classified into customers (see FIG. 7A) and staff members (see FIG. 7B), and respective positional information thereof acquired. FIG. 8 shows an example of the positional information of customers. The positional information of a customer is formed by extracting the time-point information and positional information at which a specified customer was detected, using as an index the tag ID from the collected data. As an example, FIG. 8 shows in the form of a time sequence the detection location and time-point thereof and detection of customers carrying cards having tag ICs on which tag IDs C-1001, C-1002, . . . C-2003 are displayed.

Also, FIG. 9 is an example of the positional information of staff. The positional information of staff is formed by extracting the time-point information and positional information of the detection of specified staff, using the tag ID from the collection data as an index, in the same way as in the case of the positional information of customers. As an example, FIG. 9 shows in the form of a time sequence the detection location and time-point thereof of detection of staff carrying cards having tag ICs on which tag IDs C-9001, C-9002 are displayed.

It should be noted that, as shown in FIG. 9, a not-permitted flag could be provided in respect of users (in this case, staff) With this flag, it is possible to establish beforehand for each tag ID regions to which entry is permitted and regions to which entry is not permitted. If the detected location is in a region to which entry is permitted, for example "0" is recorded; if the detected location is in a region to which entry is not permitted, for example "1" is recorded. This not-permitted flag can also be utilized for security management by detecting entry to a restricted area by setting a not-permitted flag for each detector ID in respect of staff members or customers.

Movement history regarding customers or staff members at each location can be acquired by sorting the collected data in accordance with detector ID. FIG. 10 shows an example of movement history of customers at a specified location. Movement history of customers at a specified location can be formed by extracting from the collected data the time-point information and tag ID detected at this specified location, using the detector ID as an index. As an example, FIG. 10 shows the detected tag IDs of users (customers and staff members) and their time-points in the form of a time sequence at the locations of detectors represented by detector IDs P-1001, P-1002. It should be noted that, in the state of movement of users at each such location, the state of movement of customers and staff members can be distinguished. Since the presence of users at a specified location can be ascertained by means of the state of movement of the users at this specified location, this can be utilized to improve the various services in the hotel.

Utilization history information for each tag ID (each card) can be acquired by sorting the collected data in accordance with tag ID. FIG. 11 shows an example of utilization history information of each card. Card utilization history information can be formed by extracting from the collected data the time-point information at which the card was utilized, using the tag ID as an index. In FIG. 11, as an example, the card utilization history of the tag IDs C-1001, C-1002 is shown as a time sequence. This can be linked with guest room No. utilization history by utilizing the correspondence relationship between tag ID and guest room No.

FIG. 7A, described above, shows an example of the correspondence relationship of tag ID and guest room No. and user (customer) name; FIG. 7B shows an example of correspondence data showing the correspondence relationship between tag ID and staff No. Such a correspondence relationship can be set up in respect of customers at the front desk for example when issuing a card or can be set up at the hotel server or positional information management server. Also, in respect of staff members, such a correspondence relationship can be set up beforehand at the hotel server or positional information management server.

Also, by utilizing the correspondence relationship between this tag ID and guest room No. and the correspondence relationship between tag ID and staff No., even if only the guest room No. or staff No. is known, but the tag ID is not known, by using this correspondence relationship, it is possible to read the positional information by reading the tag ID from the guest room No. or staff No.

By setting up a restricted area wherein entry to the hotel or facilities is restricted by tag ID and comparing the detected tag ID with the restricted area data, security decisions can be made by detecting entry to the restricted area. FIG. 12 shows an example of restricted area data. In FIG. 12, taking staff as an example, a normal duties region and a restricted area are set up using detector IDs. If the detected location (detector ID) is within the restricted area, it may be concluded that entry into the restricted area has taken place and for example the not-permitted flag of FIG. 9 may be set.

Next, a description will be given of searching for a user using recorded positional information. With this search processing for users, searching for a user who has become lost in the hotel or for services can be performed or call-out of staff can be facilitated.

Figure 13:
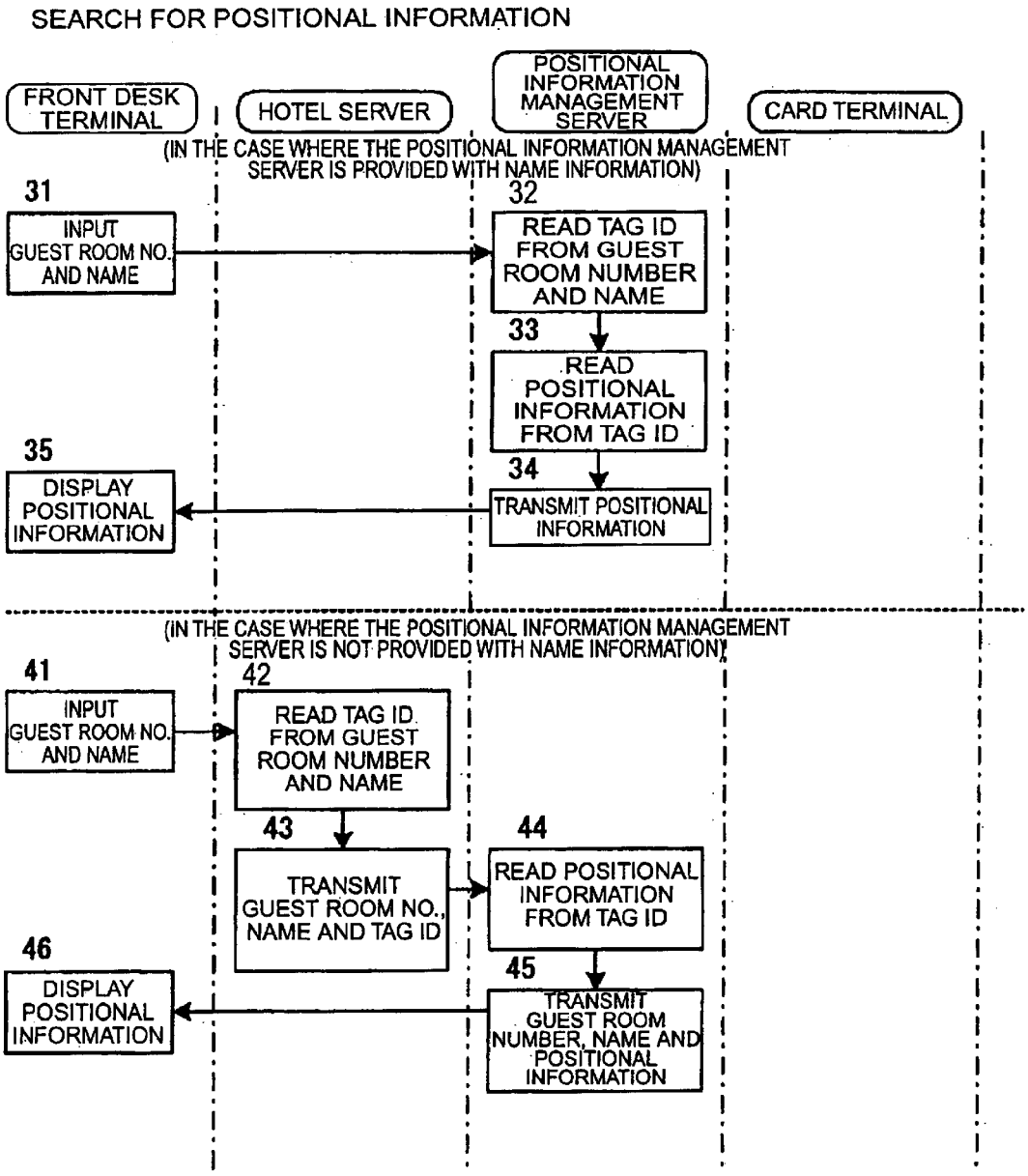
FIG. 13 is a diagram of operational condition given in explanation of searching for a customer using a positional information management system according to the present invention.

First of all, searching for a customer using the front desk terminal will be described using the operating condition diagram of FIG. 13. In FIG. 13, (31) to (35) show the case where the positional information management server is provided with customer name information and (41) to (45) show the case where the positional information management server is not provided with customer name information.

First of all, the case where the positional information management server is provided with customer name information will be described with reference to the upper part FIG. 13. When the location of a customer is sought using the front desk terminal, the guest room No. and/or name are input at the front desk terminal and transmitted (31) to the positional information management server. If only a single person is using the guest room, the user who is being sought can be specified solely by means of the guest room No. If two or more persons are using the guest room, the person who is being sought can be identified using the guest room number and name. It should be noted that, even if two or more persons are using the same room, it is not necessary to identify the person who is being sought by name if either the tag ID of the person who is being sought is known or the tag IDs of the users other than the person is being sought are known. It is also possible for the guest room No. to be read and input at the front desk terminal by a roommate using is the tag ID of the roommate's own card.

The positional information management server reads (32) the tag ID using the correspondence relationship between guest room No. (name) and tag ID, using the guest room No. and/or name that are input from the front desk terminal. Using the tag ID that has thus been read, the positional information management server reads (33) the positional information and transmits (34) this to the front desk terminal. The front desk terminal then displays (35) the positional information that has been thus transmitted thereto.

Next, the case where the positional information management server is not provided with the name information of customers will be described with reference to the lower part of FIG. 13. The name information of the customer is stored by the hotel server. In this case, the guest room No. and/or the name are input at the front desk terminal and the guest room No. (name) is transmitted (41) to the hotel server from the front desk terminal. Using the guest room No. (name) that is input thereto from the front desk terminal, the hotel server then reads (42) the tag ID, using the correspondence relationship between guest room No. (name) and tag ID, and transmits (43) the guest room No. (name) and tag ID to the positional information management server.

The positional information management server reads (44) the positional information using the tag ID that has thus been transmitted and transmits (45) the guest room No., name and positional information to the front desk terminal. The front desk terminal displays (46) the positional information that has thus been transmitted thereto. FIG. 14 is an example of the data provided on the hotel server; by setting the tag ID in addition to the information of the guest room No. and/or user, the correspondence relationship of guest room No., name and tag ID can be recorded.

Apart from the front desk terminal, searching for a customer can also be performed from the card terminal that is installed in the hotel or a facility thereof. Next, the case of searching for a customer using the card terminal will be described with reference to the operational condition diagram of FIG. 15. It should be noted that, in FIG. 15, (51) to (61) indicate the case where the positional information management server is provided with the name information of customers and (71) to (82) indicate the case where the positional information management server is not provided with the name information of customers.

Figure 15:
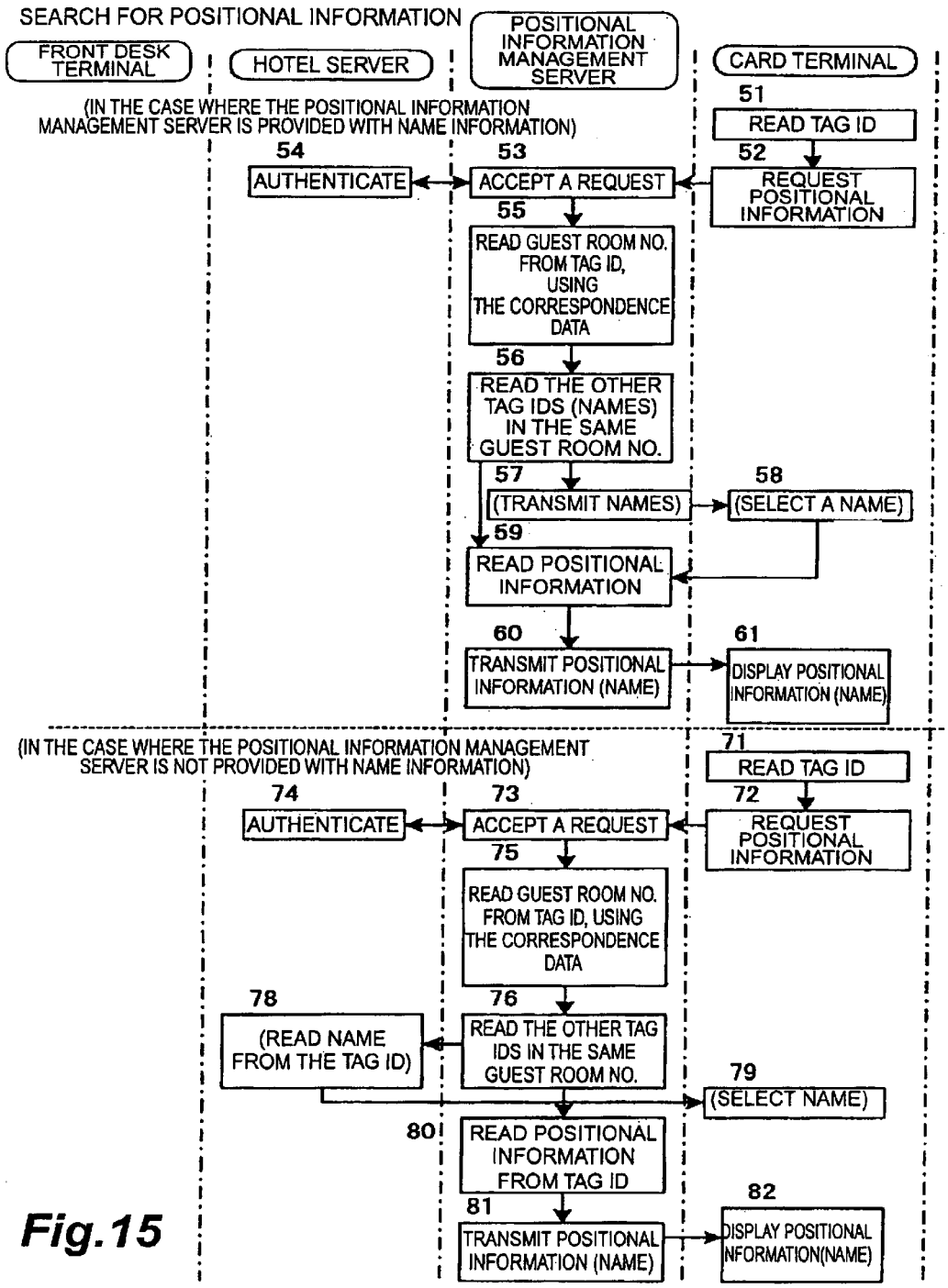
FIG. 15 is a diagram of operational condition given in explanation of searching for a customer using a positional information management system according to the present invention.

First of all, an example in which a user of the same room is searching for another user and the positional information management server is provided with the name information of customers will be described with reference to the upper part of FIG. 15. One user causes the card terminal to read (51) the tag ID of the card which this user is himself carrying and requests (52) the positional information management server to provide the positional information of the other user.

On receipt of this request, the positional information management server requests (53) the hotel server for authentication. The hotel server performs authentication using the information read from the card. This authentication may involve authentication of the user who has made the request or authentication as to whether or not the user in respect of whom the request for positional information has been made has given permission for his own positional information to be provided to others. For example, as shown in FIG. 14, authentication data as to whether or not provision of information is permitted may be set in the hotel server in user information. Granting or withholding permission for the provision of the user's own positional information is effected with reference to this authentication data. For example, regarding the data that the guest room No. is R-101, the user whose tag ID is set as C-1001 permits provision of this information whereas the user whose tag ID is set as C-1002 does not permit provision of this information.

In this case, if the user having the card of tag ID: C-1001 requests the location of the user having the card of tag ID: C-1002, since the user of tag ID: C-1002 does not permit provision of such information, the user of tag ID: C-1001 cannot acquire the location of the user of tag ID: C-1002. In contrast, if the user of tag ID C-1002 requests the location of the user of tag ID C-1001, since the user of tag ID C-1001 permits provision of such information, authentication is performed and the user of C-1002 can acquire (54) the location of the user of C-1001.

After the positional information management server has obtained authentication from the hotel server, the positional information management server reads (55) the guest room No. from the tag ID, using the correspondence data. The positional information management server then reads (56) the other tag IDs (or names) that are recorded in the guest room No. If the tag ID (or name) that is thus read is that of a single individual, the positional information of this individual is read (59). If the tag IDs (or names) that are thus read are those of two or more persons, the candidate names (of the users that have given permission for this) are transmitted (57) to the card terminal and a name is selected (58) at the card terminal and the positional information of this selected name is read (59). The positional information and name that are thus read are transmitted (60) to the card terminal and displayed (61) at the card terminal.

Next, an example of searching for another user by a user of the same room in the case where the positional information management server is not provided with customer name information is described with reference to the lower part of FIG. 15. The one user causes the tag ID of the card which he himself carries to be read (71) by the card terminal and requests (72) the positional information of the other user from the positional information management server.

On receiving this request, the positional information management server seeks (73) authentication from the hotel server. The hotel server performs the same authentication processing (74) as described above (54). After obtaining authentication from the hotel server, the positional information management server reads (75) the guest room No. from the tag ID, using the correspondence data. The positional information management server then reads (76) the other tag IDs (or names) that are recorded in this guest room No. If the tag ID (name) that is thus read is that of a single individual, the positional information thereof is read (77). If the tag IDs (names) that are thus read are those of two or more individuals, the tag IDs and names are read (78) from the hotel server and the candidate names (of users who have permitted the provision of such positional information about themselves) are transmitted to the card terminal. A selection is then made (79) at the card terminal of the name of the user who is being sought, from the plurality of candidate names that have thus been received, and the positional information thereof is read in accordance with the name that has thus been selected (80). The positional information and name that are thus read are then transmitted (81) to the card terminal and displayed (82) on the card terminal.

Figure 16:
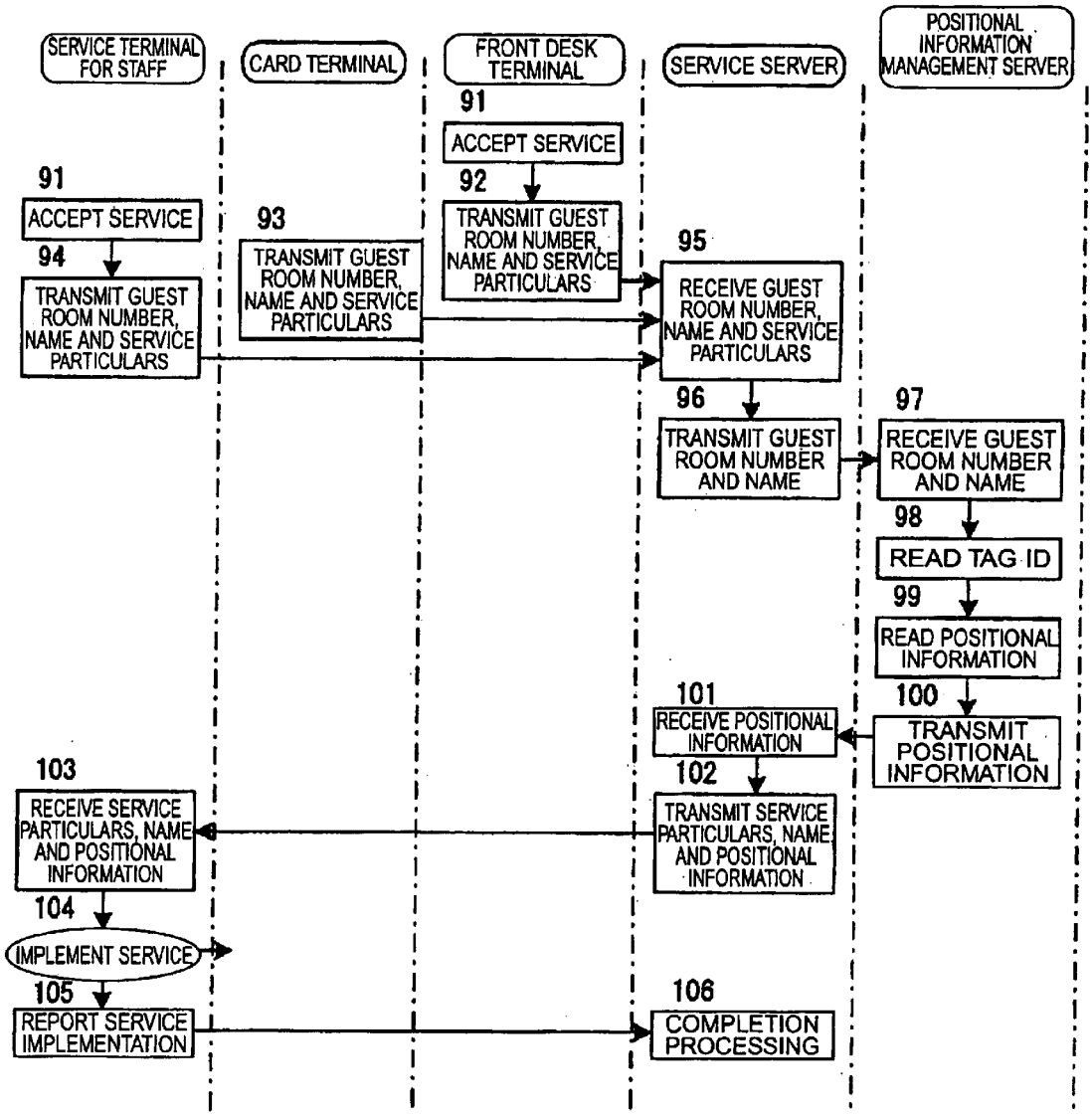
FIG. 16 is a diagram of operational condition given in explanation of service provision using positional information in a positional information management system according to the present invention.

With a positional information management system according to present invention, service provision can be performed in accordance with the positional information. FIG. 16 is a diagram of operational condition given in explanation of service provision using positional information in a positional information management system.

A service request from a customer can be accepted at the front desk, by service staff, or by a card terminal. If a service request is accepted (81) at the front desk or by service staff, the guest room No. and name of the user making the service request and the service particulars are input from the front desk terminal or a service staff terminal and transmitted (92, 94) to the service server. It is also possible for a user himself to input the user's guest room No., name and service particulars from a card terminal, which then transmits (93) these to the service server. After receiving (95) the guest room No., name, and service particulars, the service server then transmits (96) the guest room No. and name to the positional information management server.

After receiving (97) the guest room No. and name, the positional information management server reads (98) the tag ID by using the correspondence data and reads (99) the positional information using the tag ID and transmits (100) the positional information to the service server.

After receiving (101) the positional information, the service server transmits (102) the service particulars, name and positional information to the service staff terminal. Having received (103) the service particulars, name and positional information, the service staff terminal then implements (104) the service. After the service has thus been implemented, completion of service implementation is reported (105) to the service server. On receiving this report, the service server performs service completion processing (106).

Figure 17:
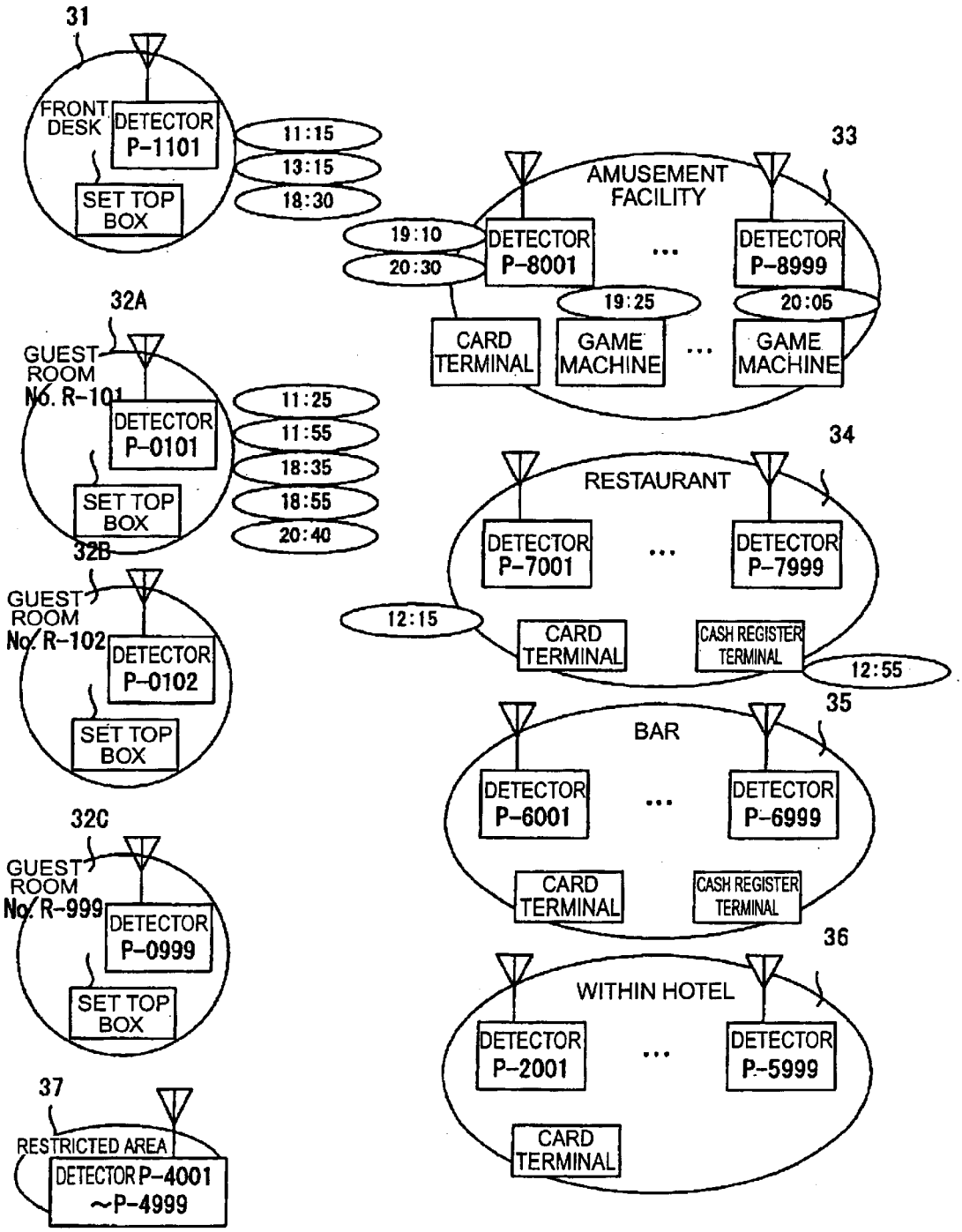
FIG. 17 is an example of the display of movement history in a positional information management system according to the present invention.

The positional information management server can display the movement history of a user by using the acquired positional information. FIG. 17 shows an example of the display of movement history in respect of a given individual user (customer); this shows how the customer has moved, together with the time-points of such movement, at the various locations within the hotel or facility. It should be noted that this is merely one example of a display and display could be effected in any other desired mode such as for example tabular display (for example display at each game table in a casino).

Figure 18:
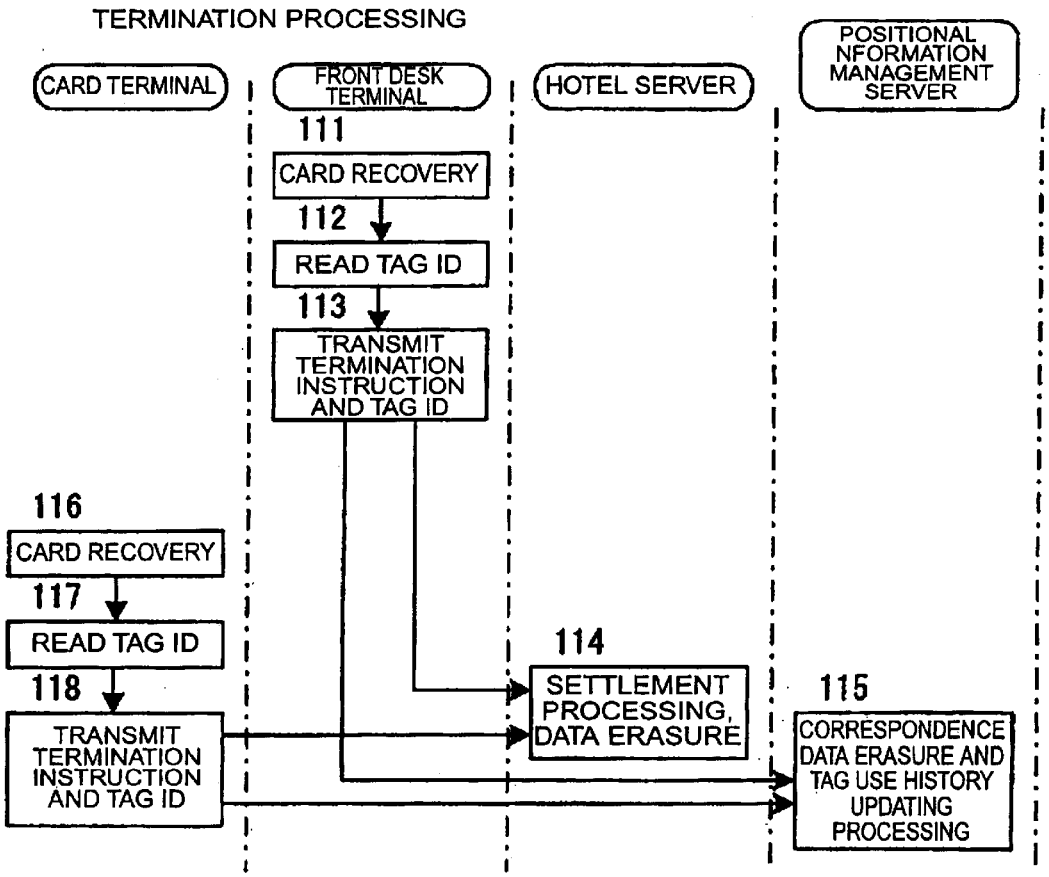
FIG. 18 is a diagram of operational condition given in explanation of card recovery processing in a positional information management system according to the present invention.

Card recovery processing can be performed together with card recovery. FIG. 18 is a diagram of operational condition given in explanation of card recovery processing. The tag ID of the card is read (112) by the front desk terminal when the card is recovered (111) at the front desk for example when checking out from the hotel. The card ID is then transmitted (113) to the hotel server and positional information management server, together with an instruction to terminate the card.

Also, if the card is recovered (116) at a card terminal, the tag ID of the card is read (117) at the card terminal and an instruction to terminate the card is transmitted (118) to the hotel server and positional information management server together with the tag ID. When the hotel server receives the termination instruction and the tag ID of the card, it performs settlement processing and erases (114) the data of the correspondence relationship between the tag ID and the guest room No. Also, when the positional information management server receives the termination instruction and the tag ID of the card, it erases the correspondence data and updates (115) the card utilization history (see FIG. 11). It should be noted that the tag ID and detector ID described above represent merely a single example and could be set at will.

With a positional information management system according to the present invention, the positional information of users can be ascertained in a hotel and various types of facilities with which the hotel is provided. Since it is possible to ascertain the location of a user within the hotel or facility, a user's whereabouts can be sought or the location of a user can be sought from a user s movement history, making it possible to conduct a search for a user. Also, the speed of provision of a service can be increased by ascertaining the locations of the user i.e. the customer and the staff member who directly provide the service. Also, by knowing customer movement history regarding when customers use hotel facilities and what kind of hotel facilities they use, it is possible to adaptively manage hotel work taking into account customer trends and intentions. Also, by knowing the movement history of staff, it is possible to adaptively manage the disposition of staff and/or staff themselves. In addition, this can be employed to improve the security of the hotel or facility.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A positional information management system comprising:

a card carried by a user in a hotel and having a tag IC for storing a tag ID;

a plurality of detectors each having a detector ID and being installed in the hotel, for detecting the tag ID via transmittance from the tag IC, the tag ID and the detector ID being transmitted;

recording means for recording a pair of the tag ID and the detector ID, and a time at which the detector has detected; and positional information management means including the recording means, for managing positional information of the user, base on the pair and the time.

2. The positional information management system according to claim 1, wherein the positional information management means specifies a position of the user based on the detector ID, and specifies the time so as to obtain a movement history of the user.

3. The positional information management system according to claim 2, wherein the user comprises a customer of the hotel and a staff member of the hotel;

wherein the positional information management system separately manages a movement history of the customers and a movement history of the staff member, based on the tag ID.

4. The positional information management system according to claim 1, wherein the detectors each have specific ranges in which each of the detectors detects the tag ID;

wherein the positional management system detects a movement state of the user, based on the specific ranges and the tag ID detected in the specific ranges.

5. The positional information management system according to claim 4, wherein the user comprises a customer of the hotel and a staff member of the hotel;

wherein the positional information management system separately manages a movement state of the customer and a movement state of the staff member, based on the tag ID.

6. The positional information management system according to claim 1, wherein the positional information management means specifies the detector ID based on the tag ID of the user to specify a position of the user based on the detector ID.

7. The positional information management system according to claim 6, further comprising a terminal connected with the positional information management means, and wherein, when the tag ID is input into the terminal, the positional information management means searches for the user based on the tag ID to transmit the positional information of the user to the terminal.

8. The positional information management system according to claim 6, wherein the recording means records a relationship between a name of the user and the tag ID, and the positional information management means specifies the tag ID of the user based on the name of the user.

9. The positional information management system according to claim 8, further comprising a terminal connected with the positional information management means, and wherein, when the name of the user is input into the terminal, the positional information management means searches for the user based on the name to transmit the positional information of the user to the terminal.

10. The positional information management system according to claim 1, wherein the user comprises a customer of the hotel and a staff member of the hotel, the positional information management system further comprises service management means for managing services for the customer; the service management means transmitts the tag ID of the customer to the positional information management means; the positional information management means specifies the detector ID to transmit positional information of the detector with the detector ID to the service management means; and the service management means manages the services for the customer based on the positional information.

11. The positional information management system according to claim 10, wherein the service management means manages services by the staff member for the customer to transmit the tag ID of the staff member to the positional information management means; the positional information management means specifies the detector ID to transmit positional information of the detector with the detector ID to the service management means; and the service management means manages the services by the staff member for the customer based on the positional information.

12. The positional information management system according to claim 1, wherein the positional information management means determines an area defined by at least one of the detector ID and determines whether or not the user is in the area based on the detector ID.

13. The positional information management system according to claim 12, wherein the positional information management system defines the area as a restricted area and manages security by generating an alarm or by setting a flag in the recording means when the user is in the restricted area.

* * * * *